US006003411A

United States Patent [19]

Knox et al.

[11] Patent Number: 6,003,411

[45] Date of Patent: Dec. 21, 1999

[54] CAM-LOBED SALVAGE TOOL

[75] Inventors: Robert L. Knox, Shiloh; James R. Wise, Columbus, both of Ga.

[73] Assignee: Snap-on Tools Company, Kenosha, Wis.

[21] Appl. No.: 09/016,987

[22] Filed: Feb. 2, 1998

[51] Int. Cl.[6] ..... B25B 13/50

[52] U.S. Cl. ..... 81/53.2; 81/124.3

[58] Field of Search ..... 8/53.2, 121.1, 8/124.3

[56] References Cited

U.S. PATENT DOCUMENTS

| | | | |
|---|---|---|---|
| 1,321,776 | 11/1919 | Stepanian . | |
| 2,197,283 | 4/1940 | Ward | 81/124.3 |
| 2,202,240 | 5/1940 | Trotter . | |
| 3,495,485 | 2/1970 | Knudsen et al. . | |
| 3,675,516 | 7/1972 | Knudsen et al. . | |
| 3,908,489 | 9/1975 | Yamamoto et al. | 81/124.3 |
| 3,996,819 | 12/1976 | King . | |
| 4,126,063 | 11/1978 | Palmer . | |
| 4,572,035 | 2/1986 | Eisenhauer . | |
| 4,598,616 | 7/1986 | Colvin . | |
| 4,607,547 | 8/1986 | Martus . | |
| 4,671,141 | 6/1987 | Hanson . | |
| 4,765,211 | 8/1988 | Colvin . | |
| 4,805,495 | 2/1989 | Tauber . | |
| 4,882,957 | 11/1989 | Wright et al. . | |
| 4,930,378 | 6/1990 | Colvin . | |
| 4,947,712 | 8/1990 | Brosnan . | |
| 4,970,917 | 11/1990 | McCollom . | |
| 5,123,310 | 6/1992 | McManus . | |
| 5,148,727 | 9/1992 | Williamson | 81/124.3 X |
| 5,361,657 | 11/1994 | Terry . | |
| 5,388,486 | 2/1995 | Ruzicka et al. . | |
| 5,476,024 | 12/1995 | Hsieh . | |
| 5,481,948 | 1/1996 | Zerkovitz . | |

*Primary Examiner*—James G. Smith
*Attorney, Agent, or Firm*—Emrich & Dithmar

[57] ABSTRACT

A salvage tool for removing worn, damaged or seized threaded fasteners includes a socket body having formed therein a fastener-receiving recess with an axis of rotation, the recess having a plurality of substantially flat planar surfaces arranged in a polygonal configuration and substantially parallel to said axis, with each of said flat planar surfaces having projecting laterally inwardly therefrom a fastener-engaging surface with inner and outer ends spaced apart in use substantially axially, each fastener-engaging surface being arcuate in transverse cross-section perpendicular to said axis and sloping away from said axis from said inner end toward said outer end.

23 Claims, 2 Drawing Sheets

CAM-LOBED SALVAGE TOOL

BACKGROUND OF THE INVENTION

1. Field of the Invention

The present invention relates to tools for turning threaded fasteners, such as bolts, nuts and the like and, in particular, relates to salvage tools for removing worn, damaged or seized threaded fasteners.

2. Description of the Prior Art

It is known to provide socket-type salvage tools with laterally inwardly projecting teeth or barbs designed to dig into the fastener surface to facilitate turning of the fastener. Such an arrangement is disclosed, for example, in U.S. Pat. No. 4,947,712. While that arrangement works relatively well for rotating the fastener, it tends to destroy the fastener, can be used only for rotation in only one direction, and tends to have a relatively short life because the teeth or barbs tend to become worn or broken in use.

It is also known to provide fastener turning tools which have corner relief regions and drive surfaces which may be arcuate, designed to engage the fastener away from the corner, to assist in turning fasteners with worn or rounded corners. However, these arrangements do not assist in rotating stuck fasteners, such as rust-seized fasteners.

SUMMARY OF THE INVENTION

It is a general object of the invention to provide an improved salvage tool which avoids the disadvantages of prior salvage tools, while affording additional structural and operating advantages.

An important feature of the invention is the provision of a salvage tool which is effective for turning both worn, and seized fasteners.

In connection with the foregoing feature, a further feature of the invention is the provision of a tool of the type set forth which can easily be applied into firm engagement with an associated fastener with a minimum of effort.

Yet another feature of the invention is the provision of a salvage tool of the type set forth, which works in any rotational direction and grips the fastener with increasing force wherever pressure is applied.

Another feature of the invention is the provision of a salvage tool of the type set forth which does not appreciably further damage the fastener.

A still further feature of the invention is the provision of a salvage tool of the type set forth which is of simple and economical construction.

Certain ones of these and other features of the invention are attained by providing a salvage tool for turning worn, damaged or seized threaded fasteners comprising: a body having an axis of rotation and plural fastener-engaging surfaces including opposed fastener-engaging surfaces on opposite sides of the axis for respectively engaging opposite sides of a fastener, each of the fastener-engaging surfaces having inner and outer ends spaced apart in use substantially axially, each of the opposed fastener-engaging surfaces being arcuate in transverse cross section perpendicular to the axis and sloping away from the axis from the inner end toward the outer end.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 2:
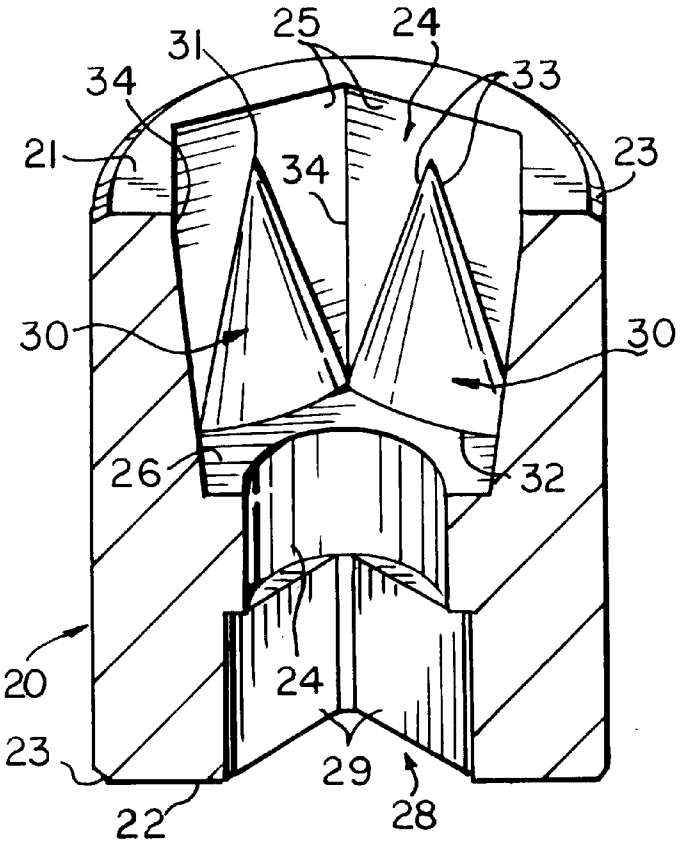
FIG. 2 is a reduced, perspective view of a vertical cross section through the salvage tool of FIG. 1.
Figure 1:
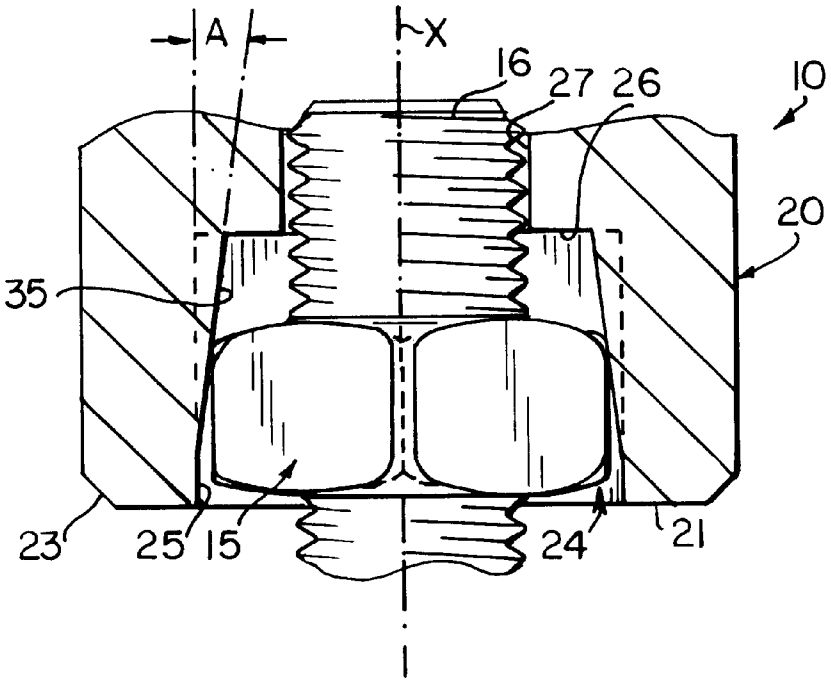
FIG. 1 is a fragmentary sectional view of a salvage tool in accordance with a first embodiment of the present invention, shown applied to an associated fastener.

Referring now to FIGS. 1–4, there is illustrated a salvage tool in the nature of a socket tool 10, constructed in accordance with a first embodiment of the invention, and adapted for turning an associated threaded fastener, such as a nut 15 on an associated bolt or stud 16. While the tool 10 is illustrated in FIG. 1 as applied to a nut, it will be appreciated that it is also applicable to headed fasteners, such as bolts, screws or the like.

The tool 10 has a generally cylindrical body 20 having an axis of rotation X and a circular drive end face 21 and a circular driven end face 22, both substantially perpendicular to the axis X and preferably chamfered at the outer peripheries thereof, as at 23. Formed in the drive end face 21 is a socket recess 24, which is preferably generally polygonal in shape, the illustrated embodiment being hexagonal. The recess 24 is defined by a plurality of interconnected, substantially flat, planar side surfaces 25, each substantially parallel to the axis X and joined at the inner end of the recess 24 by a flat, circular end wall 26 substantially parallel to the drive end face 21. Formed in the end wall 26 centrally thereof is an axial circular hole 27 which communicates with a drive square recess 28 formed in the driven end face 22, the recess 28 being defined by four flat, planar drive surfaces 29.

In use, the square recess 28 is adapted to receive therein a square drive lug of an associated driving tool, such as a breaker bar, ratchet wrench, or the like, in a known manner. The socket recess 24 is adapted to be fitted over an associated fastener of appropriate size and shape, such as the hexagonal nut 15, or an hex head of an associated headed fastener, in the manner illustrated in FIG. 1. In the event that the socket recess 24 is used with a nut on a stud or bolt, the hole 27 can provide clearance for the projecting end of the stud or bolt, as shown in FIG. 1, also in a known manner.

It is a fundamental aspect of the invention, that each of the side surfaces 25 is provided with a fastener-engaging surface 30, which is preferably non-planar and projects laterally inwardly from the associated side surface 25 toward the axis X. Each fastener-engaging surface 30 is preferably shaped as a segment of a cone, having an upper end point 31 spaced a predetermined distance below the drive end face 21 and a lower end edge 32 which intersects the end wall 26 of the socket recess 24. Each surface 30 intersects the associated flat side surface 25 of the recess 24 at downwardly diverging straight side edges 33, the lower ends of which are joined by the associated arcuate end edge 32. Preferably, the surfaces 30 are dimensioned so that the side edges 33 intersect the inner end wall 26 of the socket recess 24 at the corners or vertices 34 thereof. Because of its conical shape, the transverse cross section 35 of the surface 30 anywhere along its axial extent in sectional planes perpendicular to the axis X will be arcuate or part-circular in shape. Preferably, each surface 30 slopes away from the axis X from the inner end edge 32 to the outer end point 31 thereof at a constant slope angle A with respect the axis X, which is preferably less then 10° and, in the illustrated embodiment is substantially 7°.

In use, the tool 10 is fitted over an associated fastener 15 of appropriate size and shape, and the fastener-engaging surfaces 30 are respectively wedged into engagement with the corresponding flats of the fastener, as with a moderate tap of a hammer (see FIG. 1). Thus, each fastener-engaging surface 30 will engage the associated fastener flat substantially centrally of the surface 30, i.e., substantially midway between the side edges 33, at the point on the surface 30 which, at that axial location, is furthest from the associated socket recess side surface 25. As the tool 10 is rotated about the axis X in either direction, the tool 10 grips the fastener 15 with an increasing force, as the fastener-engaging surfaces 30 tend to move away from the centers of the fastener flats toward the corners of the fastener. Thus, the tool will not slip on the fastener, and will exert sufficient turning force to remove a stuck or seized fastener. Furthermore, since the fastener-engaging surfaces 30 engage the fastener flats substantially centrally thereof at the portions least likely to be worn or damaged, the tool 10 is effective for turning worn or damaged fasteners.

Figure 5:
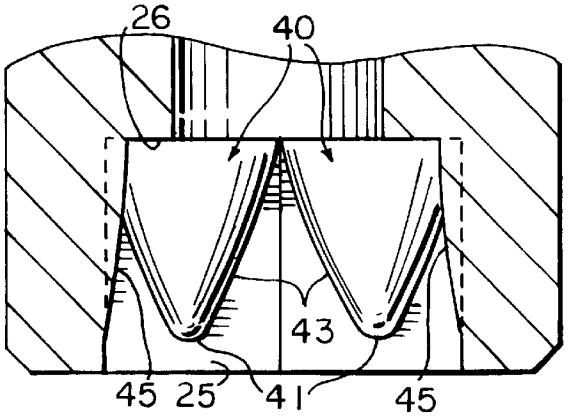
FIG. 5 is a view similar to FIG. 3 of a second embodiment of the invention.
Figure 6:
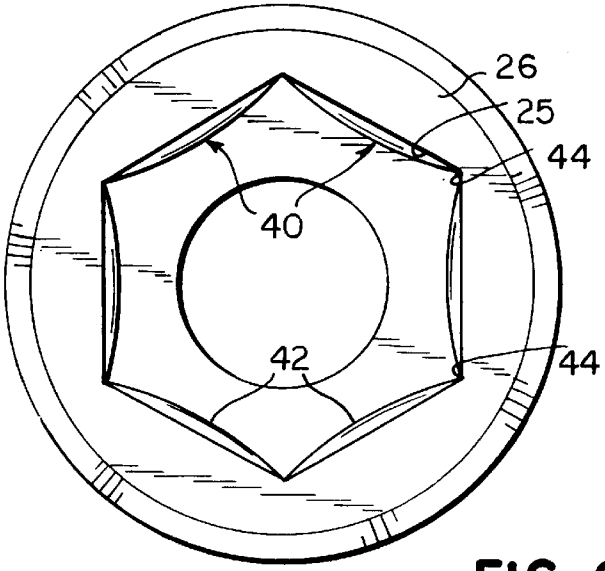
FIG. 6 is a bottom plan view of the salvage tool as illustrated in FIG. 5.
Figure 3:
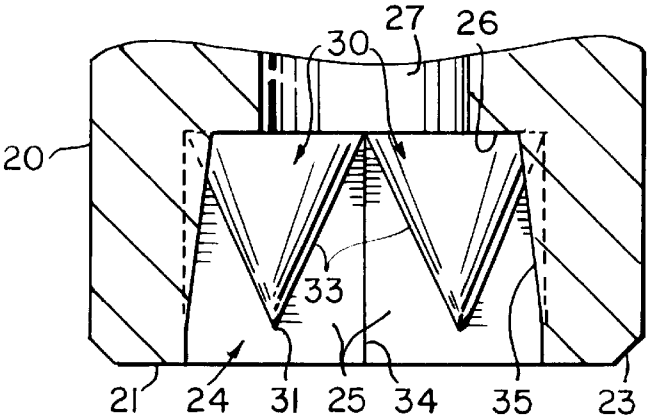
FIG. 3 is a view similar to FIG. 1 with the fastener removed.
Figure 4:
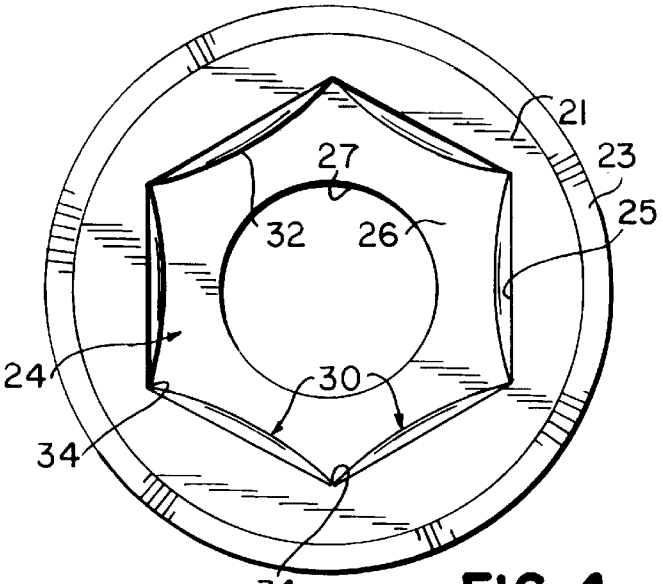
FIG. 4 is a bottom plan view of the salvage tool as illustrated in FIG. 3.

Referring to FIGS. 5 and 6, there is shown an alternative embodiment of the socket tool of the present invention, which is substantially identical to the socket tool 10, except for the shape of the fastener-engaging surfaces which, in this case, are generally designated 40. Each of the fastener-engaging surfaces 40 is substantially similar in shape to the fastener-engaging surfaces 30, except that the slope of the surface away from the axis X from the inner end edge to the outer end point is variable rather than fixed, so that the surface 40 does not form a segment of a true cone.

More particularly, each fastener-engaging surface 40 extends axially from an outer end apex 41, which may be somewhat rounded, to an inner end edge 42, which is arcuate and intersects the end wall 26 of the socket recess 24. Each fastener-engaging surface 40 intersects the associated flat side surface 25 of the socket recess 24 at downwardly diverging arcuate side edges 43, which respectively intersect the socket recess end wall 26 at the corners or vertices 44 of the recess 24. Because each fastener-engaging surface 40 is a segment of a generally bullet-shaped structure rather than a true cone, the slope of the surface 40 relative to the axis X varies along its axial extent, as indicated at 45. But each inner end edge 42 will still be substantially part-circular, as will the transverse cross section of the surface 40 taken anywhere along its axial length in a sectional plane substantially perpendicular to the axis X.

In operation, the tool with fastener-engaging surfaces 40 operates in substantially the same manner as the tool of FIGS. 1–4, described above.

While the present invention has been illustrated in the context of a socket tool, it will be appreciated that the principles of the present invention are also applicable to end wrenches, such as box end wrenches, and may also be applicable to open end wrenches, wherein each jaw of the wrench has a fastener-engaging surface 30 or 40. In the preferred embodiments the fastener-engaging surfaces 30 and 40 terminate short of the drive end face 21 to provide a lead-in distance for fasteners which are closely-fitted to the recess 24 with little clearance space. However, if desired, the fastener-engaging surfaces 30 and 40 could extend the full axial extent of the socket recess 24.

From the foregoing, it can be seen that there has been provided an improved salvage tool which is effective for turning worn, damaged or seized threaded fasteners, being firmly and positively engageable with the fastener with the exertion of only moderate force and providing non-slip application of increasing rotational force to the fastener without substantially damaging the fastener.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A socket tool comprising:

a body having formed therein a fastener-receiving recess with an axis of rotation, said recess having a plurality of fastener-engaging surfaces each having an inner end and an outer end spaced apart in use substantially axially, each of said fastener-engaging surfaces forming a conical segment in transverse cross-section perpendicular to said axis and sloping at a constant slope away from said axis from said inner toward said outer end.

2. The tool of claim 1, wherein the number of said fastener-engaging surfaces is greater than two and said surfaces cooperate to define a closed configuration.

3. The tool of claim 2, wherein said configuration is polygonal in shape.

4. The socket tool of claim 1, wherein said fastener-engaging surfaces are six in number and cooperate to define a hexagonal configuration.

5. The socket tool of claim 1, wherein said body further includes an inner end surface substantially perpendicular to said axis and intersecting each of said fastener-engaging surfaces at its inner end, said inner end surface having an opening therein centrally thereof.

6. The socket tool of claim 1, wherein said slope is inclined at an angle of approximately 7° with respect to said axis.

7. The socket tool of claim 1, wherein said body includes a plurality of substantially flat planar surfaces equal in number to said fastener-engaging surfaces and substantially parallel to said axis, said fastener-engaging surfaces respectively intersecting said flat planar surfaces and projecting laterally inwardly therefrom toward said axis.

8. The socket tool of claim 7, wherein each of said flat planar surfaces has an outer end spaced axially from the outer end of the corresponding fastener-engaging surface.

9. The socket tool of claim 1, wherein said fastener-engaging surfaces include opposed fastener-engaging surfaces on opposite sides of said axis for respectively engaging opposite sides of a fastener.

10. A socket tool comprising:

a body having formed therein a fastener-receiving recess with an axis of rotation, said recess having a plurality of fastener-engaging surfaces each having an inner end and an outer end spaced apart in use substantially axially, each of said fastener-engaging surfaces being arcuate in transverse cross-section perpendicular to said axis and sloping at a varying slope away from said axis from said inner toward said outer end.

11. The socket tool of claim 10, wherein said fastener-engaging surfaces are six in number and cooperate to define a hexagonal configuration.

12. The socket tool of claim 10, wherein said body further includes an inner end surface substantially perpendicular to said axis and intersecting each of said fastener-engaging surfaces at its inner end, said inner end surface having an opening therein centrally thereof.

13. The socket tool of claim 10, wherein said body includes a plurality of substantially flat planar surfaces equal in number to said fastener-engaging surfaces and substantially parallel to said axis, said fastener-engaging surfaces respectively intersecting said flat planar surfaces and projecting laterally inwardly therefrom toward said axis.

14. The socket tool of claim 13, wherein each of said flat planar surfaces has an outer end spaced axially from the outer end of the corresponding fastener-engaging surface.

15. The socket tool of claim 10, wherein said fastener-engaging surfaces include opposed fastener-engaging surfaces on opposite sides of said axis for respectively engaging opposite sides of a fastener.

16. A socket tool comprising:

a body having formed therein a fastener-receiving recess with an axis of rotation, said recess having a plurality of fastener-engaging surfaces each having an inner end and an outer end spaced apart in use substantially axially, each of said fastener-engaging surfaces being arcuate in transverse cross-section perpendicular to said axis and sloping away from said axis from said inner toward said outer end, said body including a plurality of substantially flat planar surfaces equal in number to said fastener-engaging surfaces and substantially parallel to said axis, said fastener-engaging surfaces respectively intersecting said flat planar surfaces and projecting laterally inwardly therefrom toward said axis, each of said flat planar surfaces having an outer end spaced axially from the outer end of the corresponding fastener-engaging surface.

17. The socket tool of claim 16, wherein each of said fastener-engaging surfaces has a variable slope.

18. The socket tool of claim 16, wherein said fastener-engaging surfaces are six in number and cooperate to define a hexagonal configuration.

19. The socket tool of claim 16, wherein said body further includes an inner end surface substantially perpendicular to said axis and intersecting each of said fastener-engaging surfaces at its inner end, said inner end surface having an opening therein centrally thereof.

20. The socket tool of claim 16, wherein said fastener-engaging surfaces include opposed fastener-engaging surfaces on opposite sides of said axis for respectively engaging opposite sides of a fastener.

21. The tool of claim 16, wherein the number of said fastener-engaging surfaces is greater than two and said surfaces cooperate to define a closed configuration.

22. The tool of claim 21, wherein said configuration is polygonal in shape.

23. The tool of claim 16, wherein said slope is inclined at an angle of approximately 7° with respect to said axis.

* * * * *